US006339292B1

(12) United States Patent
Ha

(10) Patent No.: US 6,339,292 B1
(45) Date of Patent: Jan. 15, 2002

(54) COLOR PDP WITH ARC DISCHARGE ELECTRODE AND METHOD FOR FABRICATING THE SAME

(75) Inventor: Hong Ju Ha, Inchon-kwangyoksi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/176,944

(22) Filed: Oct. 22, 1998

(30) Foreign Application Priority Data

Oct. 24, 1997 (KR) ..... 97/54826

(51) Int. Cl.[7] ..... H01J 17/49

(52) U.S. Cl. ..... 313/582; 313/586; 313/587; 445/24

(58) Field of Search ..... 313/582, 583, 313/584, 585, 586, 587, 479, 495, 496, 497; 445/24

(56) References Cited

U.S. PATENT DOCUMENTS 4,626,071 A * 12/1986 Wada et al. ..... 350/311
5,541,479 A * 7/1996 Nagakubo ..... 313/586
5,548,421 A * 8/1996 Miyazaki ..... 359/54
5,742,122 A * 4/1998 Amemiya et al. ..... 313/582
5,808,413 A * 9/1998 Bongaerts et al. ..... 313/582
5,838,105 A * 11/1998 Mitomo ..... 313/582
5,959,403 A * 9/1999 Lee ..... 313/582
6,043,604 A * 3/2000 Horiuchi et al. ..... 313/582
6,107,739 A * 8/2000 Ha ..... 313/582

FOREIGN PATENT DOCUMENTS

JP 57212743 A 12/1982
JP 02168533 A 6/1990
JP 05012991 A 1/1993

* cited by examiner

*Primary Examiner*—Nimeshkumar D. Patel
*Assistant Examiner*—Mariceli Santiago
(74) *Attorney, Agent, or Firm*—Fleshner & Kim, LLP

(57) ABSTRACT

Color plasma display panel with arc discharge electrodes, which has an optical structure without cross talks between adjacent electrodes to maximize a discharge area, the panel including a top panel having a plurality of pairs of arc discharge electrodes formed on a same plane with a first insulating substrate and a dielectric film on an entire surface of the pairs of arc discharge electrodes for restricting a discharge current, a bottom panel having barriers formed on the second insulating substrate for providing different colors between adjacent cells opposite to the arc discharge electrodes, address electrodes formed on inside surfaces of the barriers, and fluorescent material films one entire surfaces of the address electrodes, Frit glass for bonding the top and bottom panels, and a mixture gas filled, and sealed in discharge regions of cells.

10 Claims, 3 Drawing Sheets

COLOR PDP WITH ARC DISCHARGE ELECTRODE AND METHOD FOR FABRICATING THE SAME

BACKGROUND OF THE INVENTION

1. Field of the Invention

The present invention relates to a color plasma display panel (hereafter called as PDP), and more particularly, to a color PDP with an arc discharge electrode; and a method for fabricating the same.

2. Background of the Related Art

In general, the PDP is the most suitable for a flat display panel because the PDP has a fast data display rate and a large sized panel is available with easy. The PDP is suggested to an AC type PDP or DC type PDP both with two electrodes, of which it is known that a surface discharge type AC PDP is the most appropriate for a color display.

FIG. 1 illustrates a cross section of a related art surface discharge type PDP cell, with a direction of discharge electrodes 13 on a first insulating substrate 11 shown rotated by 90° for convenience of understanding.

Referring to FIG. 1, the related art PDP is provided with one pair of discharge electrodes 13 arranged on the same plane of the first insulating substrate 11. And, there is a top panel provided with a first, and a second dielectric films formed on an entire surface of the first insulating substrate 11 inclusive of the first discharge electrodes 13 for limiting a discharge current, and an MgO protection film 16 on an entire surface. Each of the discharge electrodes 13 has a metal electrode 10 formed at a region thereof There is an address electrode 17 on a region of a second insulating substrate 12 in a direction perpendicular to a direction of the discharge electrodes 13 on the top panel. There are barriers 19 between the address electrodes 17 for providing different colors and fluorescent films coated on the barriers 19 and the address electrodes 17, thereby forming a bottom panel. The first insulating substrate 11 in the top panel and the second insulating substrate 12 in the bottom panel are bonded together with Frit glass(not shown), and then, a mixture of gases are filled in discharge regions 20, which are then sealed tightly.

Upon application of a driving voltage between one pair of discharge electrodes 13 in the aforementioned related art PDP, a surface discharge 20*a* is occurred at the discharge region 20 of surfaces of the first, and second dielectric films 14 and 15 by the filled mixture gas, to emit ultra-violet(UV) rays. The UV ray excites the fluorescent film 18, to generate a visible light, displaying R(Red), G(Green), and B(Blue) colors depending on the fluorescent film 18. That is, spatial charges present in the discharge region 20 are accelerated by the driving voltage, make the mixture gas filled in the discharge region 20 at an internal pressure of 400~500 Torr, i.e., inert gas collision onto the fluorescent film 18, to generate a vacuum UV ray in a Penning effect during the collision. The inert mixture gas has helium He as a major gas with addition of xenon Xe, and neon Ne gases. In other words, when the vacuum UV ray hits the fluorescent film 18 coated on the address electrode 17 and the barrier 19, the fluorescent film 18 become luminant in a visible range. A color display is made by a combination of the R, G, B colors, defined at least three luminous regions.

However, because the related art PDP causes surface discharge according to the counter discharge principle upon application of a discharge initiation voltage between discharge electrodes, if a distance between the electrodes is made greater for having a larger discharge space, the discharge voltage rises, with a increased power consumption and a shortened lifetime.

SUMMARY OF THE INVENTION

Accordingly, the present invention is directed to a color PDP with an arc discharge electrode and a method for fabricating the same that substantially obviates one or more of the problems due to limitations and disadvantages of the related art.

An object of the present invention is to provide a color PDP which can cause a discharge with easy, enlarge a discharge space, and reduce dispersion of a discharge, for improving a discharge efficiency.

Another object of the present invention is to provide a color PDP which has a clear distinction between discharge regions and non-discharge regions, and can provide a difference of light paths for these two regions, for improving a contrast.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the color plasma display panel with arc discharge electrodes includes a top panel having a plurality of pairs of arc discharge electrodes formed on a same plane with a first insulating substrate and a dielectric film on an entire surface of the pairs of arc discharge electrodes for restricting a discharge current, a bottom panel having barriers formed on the second insulating substrate for providing different colors between adjacent cells opposite to the arc discharge electrodes, address electrodes formed on inside surfaces of the barriers, and fluorescent material films one entire surfaces of the address electrodes, Frit glass for bonding the top and bottom panels, and a mixture gas filled, and sealed in discharge regions of cells.

In the other aspect of the present invention, there is provided a method for fabricating a color plasma display panel with arc discharge electrodes including the steps of (1) providing a first insulating substrate for displaying an image, (2) forming a first dielectric film on the first insulating substrate, (3) forming a recess of an arc form in a prescribed region of the first dielectric film, (4) forming one pair of arc discharge electrodes with a gap therebetween in the recess of an arc form in the first dielectric film, and (5) forming a second dielectric film on an entire surface inclusive to of the arc discharge electrodes, thereby completing fabrication of a top panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
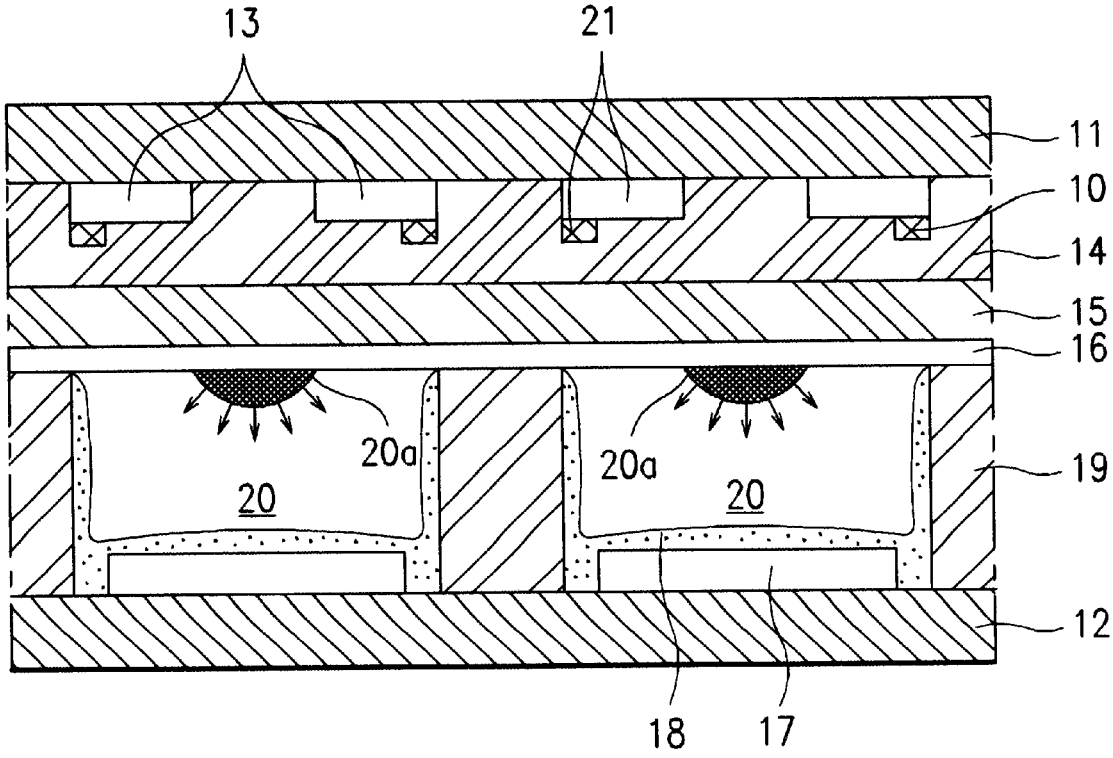
FIG. 1 Related art
FIG. 1 illustrates a cross section of related art cells of a color plasma display panel; and, FIG. 2 iillustrates a cross section of cells of a color plasma display panel in accordance with a preferred embodiment of the present invention.
Figure 2:
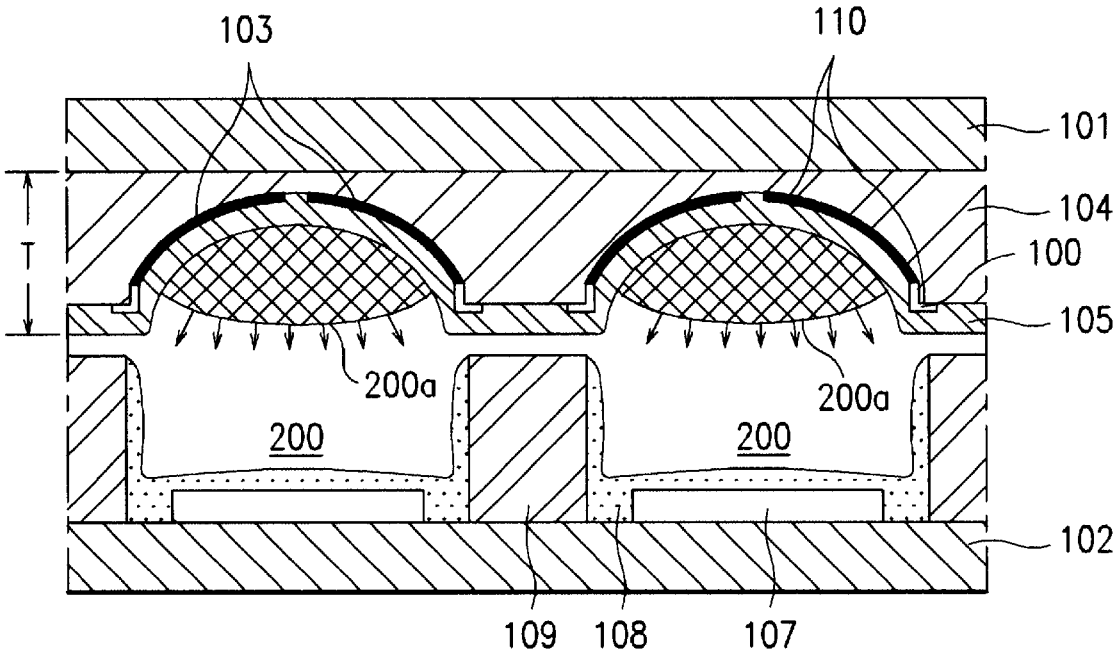
FIG. 2A illustrates a cross section of cells of a color plasma display panel in accordance with another embodiment of the invention.

Reference will now be made in detail to the preferred embodiments of the present invention, examples of which are illustrated in the accompanying drawings. FIG. 2 illustrates a cross section of cells of a color plasma display panel in accordance with a preferred embodiment of the present invention, wherein one pair of arc discharge electrodes 103 on a first insulating substrate 101 are turned by 90° for easy understanding.

Figure 2A:
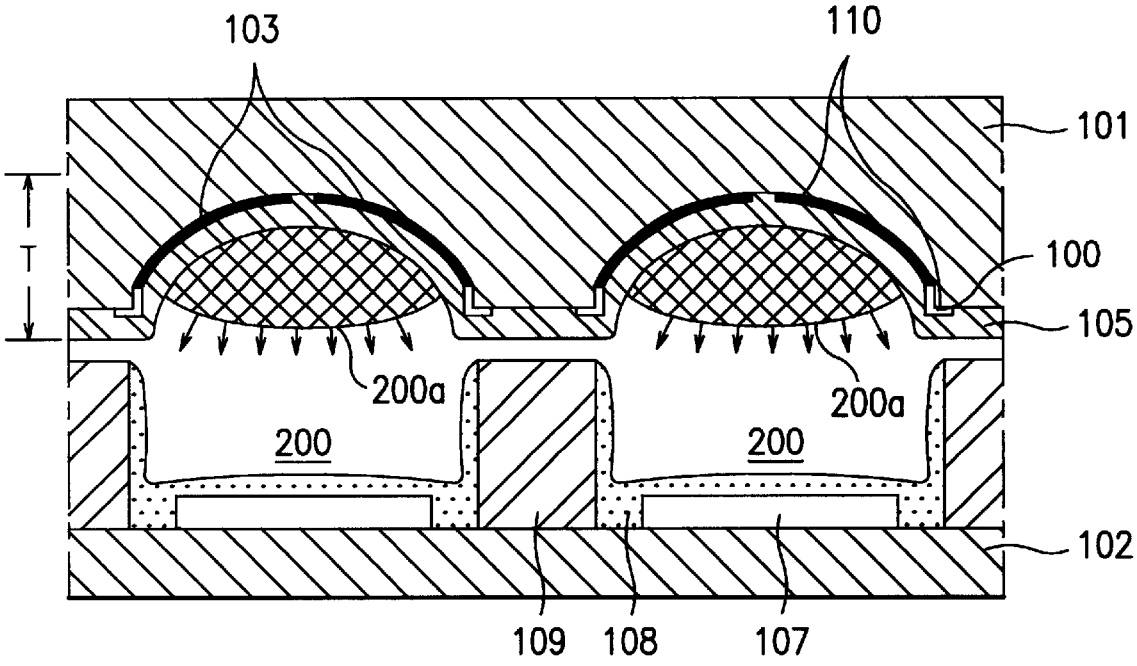

Referring to FIG. 2, a first dielectric film 104 is formed on the first insulating substrate 101. An arc shaped recess is etched in a region of the first dielectric film 104. Indium oxide $InO_2$ or tin oxide $SnO_2$ is deposited in the arc shaped recess in the first dielectric film 104 by a thin film formation process, dipping method, or screen printing, to form one pair of transparent arc discharge electrodes 103 with a gap of 40~105 $\mu$m. Then, a second dielectric film 105 is formed on an entire surface of the arc discharge electrodes 103 to a thickness for restricting a discharge current, thereby completing formation of a top panel. In this instance, instead of the first dielectric film 104, a region of the first insulating substrate 101 may be etched to form the arc form of recess and the arc discharge electrodes 103 may be formed therein, as shown in FIG. 2A. The arc discharge electrodes 103 are electrically connected to a bus electrode 100, to form a display electrode pair 110. The bus electrode 100 is formed of a conductive thin film to be in contact with both ends of the one pair of arc discharge electrodes 103 by photo lithography, or of metal paste added with black pigment by printing to a desired form and dimension. A second dielectric film 105 is formed on an entire surface of the first dielectric film 104 inclusive of the arc discharge electrodes 103 and the bus electrode 100 by printing or depositing dielectric paste in a arc form, for generating a wall charge that drops the driving voltage. A total thickness 'T' of the first dielectric film 104 and the second dielectric film 105 is 40~105 $\mu$m. Barriers 109 are formed on a second insulating substrate 102 opposite to the second dielectric film 105. A metal thin film is deposited on exposed surfaces of the second insulating substrate 102 and inside surfaces of the barriers, to form address electrodes 107. The address electrodes 107 may be formed in a metal on groove form or on the second insulating substrate 102. Then, a fluorescent material film 108 is formed on an entire surface of the address electrode 107 to a thickness by electrophoresis, thereby completing formation of a bottom panel. The fluorescent material film 108 may be formed to a thickness of 10~50 $\mu$m by printing a fluorescent material paste of cellulose+acrylic resin+organic solvent (alcohol or ester) on a surface of the address electrode 107 and baking at 400~600° C. The top panel and the bottom panel fabricated thus are bonded together with Frit glass (not shown), and the discharge region 120 is evacuated of air, filled with an inert mixture gas of neon Ne, helium He, and xenon X3, and sealed.

Upon application of a minimum driving voltage to the one pair of display electrodes 110 in the aforementioned color PDP of the present invention, a surface discharge 200*a* is caused at a surface of the second dielectric film 105 in the discharge region 200, and UV rays are emitted from the surface discharge regions 200*a*. The UV ray excites the fluorescent material film 108, to generate a visible light, which is displayed on a display surface of the first substrate 101, thereby making color display of R, G, B. Accordingly, it is found that a contrast and a luminance of the color PDP of the present invention are improved more than 4 times compared to the related art color PDP because the fluorescent material film 108 is excited by UV rays emitted from the two surface discharge regions 200*a*.

As has been explained, the color PDP with arc discharge electrodes of the present invention can satisfy both a desired luminance and a contrast by providing different reflective paths of incident lights and an optical structure in which lights generated inside of cell is converged and lead out while preventing cross talk, thereby maximizing a discharge area.

And, the surface discharge type color PDP of the present invention can prevent erroneous discharge between column electrodes by forming arc forms of arc discharge electrode pair and a dielectric film on a first insulating substrate, forming barriers on a second insulating substrate opposite to the arc discharge electrodes, and stacking an address electrode and a fluorescent film in the barriers, enlarging a discharge area, that improves a luminance and, maintaining a discharge voltage constant.

It will be apparent to those skilled in the art that various modifications and variations can be made in the color PDP with an arc discharge electrode and the method for fabricating the same of the present invention without departing from the spirit or scope of the invention. Thus, it is intended that the present invention cover the modifications and variations of this invention provided they come within the scope of the appended claims and their equivalents.

What is claimed is:

1. A plasma display panel comprising:

a top panel, comprising:

a substrate for displaying an image;

at least one pair of arc discharge electrodes formed in an arc shaped recess formed in the substrate; and a first dielectric film covering an entire surface of the at least one pair of arc discharge electrodes, wherein a driving voltage is applied between the at least one pair of arc discharge electrodes to create a surface discharge at a surface of the first dielectric film.

2. The plasma display panel as claimed in claim 1, wherein the at least one pair of arc discharge electrodes has a gap of 40~150 $\mu$m between the respective arc discharge electrodes.

3. The plasma display panel as claimed in claim 1, wherein the plasma display panel is a color display panel.

4. The plasma display panel of claim 1, wherein the plasma display panel is an AC PDP.

5. The plasma display panel as claimed in claim 1, wherein the substrate comprises a first insulating substrate and a second dielectric film.

6. The plasma display panel as claimed in claim 5, wherein the first and second dielectric films have a height of 5~300 $\mu$m from a top surface of the first insulating substrate.

7. The plasma display panel as claimed in claim 5, wherein the arc shaped recess is formed in the first insulating substrate.

8. The plasma display panel as claimed in claim 5, wherein the arc shaped recess is formed in the second dielectric film.

9. The plasma display panel as claimed in claim 5, further comprising a bottom panel disposed adjacent to the top panel.

10. The plasma display panel as claimed in claim 9, wherein the bottom panel comprises:

a second insulating substrate;

at least one address electrode disposed on the second insulating substrate; and a fluorescent film covering an entire surface of the at least one address electrode.

* * * * *